US006058867A

United States Patent [19]

Ettel

[11] Patent Number: 6,058,867

[45] Date of Patent: May 9, 2000

[54] SAILBOAT MAST INCLINING MECHANISM

[76] Inventor: Rolland Wayne Ettel, 5692 Alfred Ave., Westminster, Calif. 92683

[21] Appl. No.: 09/135,382

[22] Filed: Aug. 17, 1998

[51] Int. Cl.[7] ..... B63B 15/02

[52] U.S. Cl. ..... 114/91

[58] Field of Search ..... 114/39.32, 91, 114/143, 90

[56] References Cited

U.S. PATENT DOCUMENTS

| | | | |
|---|---|---|---|
| 148,655 | 3/1874 | Bell | 114/90 |
| 1,243,198 | 10/1917 | McDougall | 114/90 |
| 3,903,827 | 9/1975 | Marcil | 114/143 |
| 3,972,300 | 8/1976 | Adamski | 114/39.32 |
| 3,985,106 | 10/1976 | Ross | 114/91 |
| 4,117,797 | 10/1978 | Kelly | 114/91 |
| 4,638,755 | 1/1987 | Butka | 114/91 |
| 5,392,727 | 2/1995 | Christensen | 114/91 |
| 5,509,368 | 4/1996 | Wald | 114/39.1 |
| 5,570,651 | 11/1996 | Schiff | 114/91 |

*Primary Examiner*—Sherman Basinger

[57] ABSTRACT

A mechanism to improve performance and increase the speed of a sailboat by inclining the sailboat's mast and its supporting stays from side to side, enabling a sailor to lean the weight of his mast, sails and rig against the pressure of the wind. This is accomplished by placing the mast into a tube that is affixed to a tube that is bent to a radius and is supported by a cradle of hourglass shaped rollers. The shroud stays are then attached to the upper end of the tube with the radius that is stabilized by a strut back to the mast tube. The mast and shrouds can then be inclined as a structure rolling it from side to side in its cradle of rollers. The mechanism can then be operated by a variety of methods depending upon its application.

1 Claim, 3 Drawing Sheets

SAILBOAT MAST INCLINING MECHANISM

BACKGROUND OF THE INVENTION

1. Field of Invention

This invention relates to the mast and rigging of sailboats, particularly yachts and sailboats of the racing and cruising type having weighted keels.

2. Description of Prior Art

When a sailboat's destination is upwind the vessel sails at about a 45° angle from the wind's direction and zigzags or tacks back and forth to arrive at that destination. When this is done pressure of the wind is exerted against the sails which are supported by the mast and the mast's supporting stays and rigging forcing the vessel to incline or heel. This is counteracted by the righting moment of the ballasted sailboat, enabling the sailboat to move in a forward direction. The lighter the mast, rigging and sails are, and the deeper the ballast weight, the faster the vessel with a conventional fixed mast will go. What this has done to the sport of sailing is created very light but weak masts and rigging and very deep, heavy keels that are unsound.

By inclining a sailboat's mast to windward the weight of the sailboat's mast and rigging act as righting moment. The heavier and stronger the rig the more righting moment can be exerted by the rig. By doing this less righting moment is required of the ballast keel, so that it can be made shallower and stronger.

Several methods have been proposed for inclining, pivoting or swinging a mast hinging on deck. U.S. Pat. Nos. 3,903,827 to Marcil (1975), 4,117,797 to Kelly (1978), 5,392,727 to Christensen (1995), 5,509,368 to Wald (1996) and 5,570,651 to Schiff(1996), all disclose methods for inclining a mast based on the mast being hinged on the deck. This places more strain on the supporting stays and a great strain and weight at the hinge point. Hinging the mast on deck also requires a complicated shroud adjustment mechanism that is expensive to build and service.

Other methods have been proposed wherein the mast passes through the deck and are somewhat supported by the hull. U.S. Pat. Nos. 4,638,755 to Butka (1987) and 3,985,106 to Ross (1976) are of this principle. These methods have not taken into account the load that is put on the supporting stays when the mast in inclined. In these designs when the mast is inclined the lateral supporting stays or shrouds move closer to the center of the mast. Their effectiveness is greatly reduced because the angle of support is lessened. The shrouds must be tensioned independently and separately, which is very complicated to engineer.

SUMMARY OF THE INVENTION

One of the advantages of this invention is that it can be installed on a conventional sailboat using a conventional rig. The user would only have to fit and install the mechanism in the boat, shorten the side stays and connect them to the struts.

A further advantage of this invention is that the shrouds are designed to have a wider spread and better angle to support the mast. The tension loads of the shrouds are transferred through the curved tube to the base of the mast. This relieves many of the hull strains that are present with conventional rigs and prior art. The entire weight of the mast and its rigging is then supported in a curved cradle of rollers. This is much stronger than placing the weight and strains on a hinge point on deck as previously mentioned.

This mechanism is designed to increase the speed of a sailboat when going to windward or on a reach. As wind pressure is exerted on the sails, the operator by means of the mechanism inclines the mast and sails into the wind. The higher the velocity of the wind the greater the angle of inclination. The mast should always stay inclined to windward of vertical for optimum performance. When the sailboat tacks or gybes the mast is brought back to vertical and inclined on the other side again against the wind pressure. If the velocity of the wind is so great that the mast cannot be kept to windward of vertical sail area should then be reduced.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other inclining masts for carrying out the same purposes of the present invention. It should also be realized by those skilled in the art that such equivalent structures do not depart from the spirit and scope of the invention as set forth in the appended claims.

DETAILED DESCRIPTION OF INVENTION

In these drawings conventional parts of the sailboat are identified by letters. The parts of the mechanism are identified by numbers.

Figure 1:
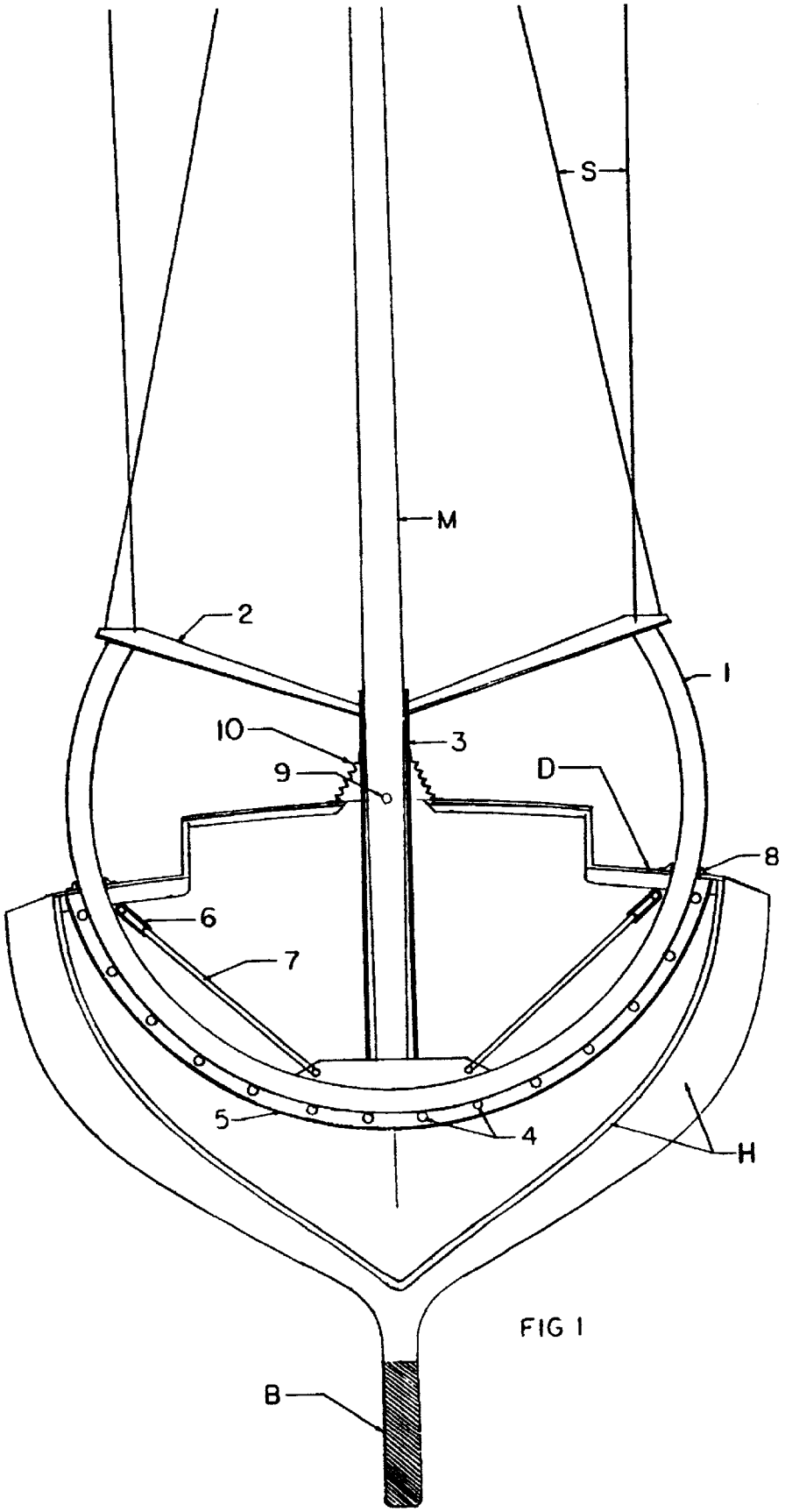
FIG. 1 is a front view of the mechanism in a stationary upright position.

Referring now to FIG. 1 showing a bent metal tube or a formed composite 1 formed or bent to a perfect radius and of sufficient strength and stiffness so as not to be deflected when the rig is loaded. 2 is a strut of a strong material, such as metal or a composite like carbon fiber, that is attached to 1. The shroud stays S are affixed to these struts. The struts are also affixed to a center tube 3. This tube is vertically attached to the center of 1, into which is housed the mast M. 1, 2, and 3 form a supporting structure for the mast and rig. This structure is then supported by a cradle of rollers 4 mounted into a supporting member 5, later described in FIG. 3. This member 5 is supported by bulkheads that are fastened or bonded to the boat's hull H.

Figure 2:
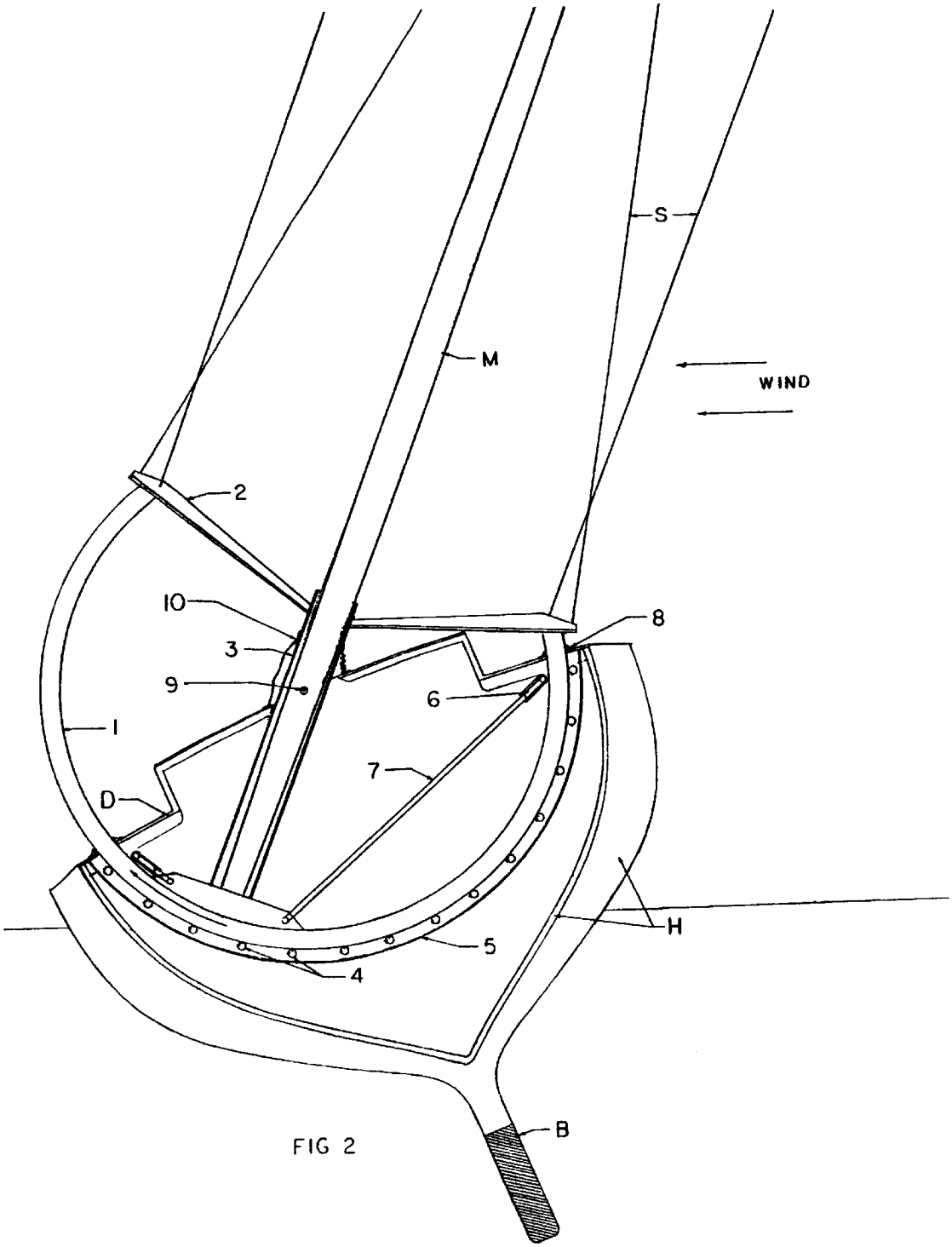
FIG. 2 is a front view illustrating the movement of the mechanism as it pivots the mast and rig laterally.

FIG. 2 illustrates the mechanism inclining laterally against wind pressure. 1, 2, and 3 support the mast and its rig, as it is pulled into the wind by a wire rope or synthetic line 7. 7 runs through a sheave 6 and can be powered hydraulically or by a series of sheaves and purchases, or by some winching device. As the mast is inclined against the wind pressure, the boat's ballast keel B is lifted against gravity, heeling the boat and putting the leeward deck close to the water. In order to prevent water from flooding the boat where 1 exits the deck a fitting with an O ring seal 8 is shown. No. 8 is shown in more detail in FIG. 3. Where 3 exits the deck an optional pivot bearing 9 is shown. This may be necessary on larger boats. 10 is a flexible coat of rubber around 3 and fastened to the deck to keep out rainwater and spray.

Figure 3:
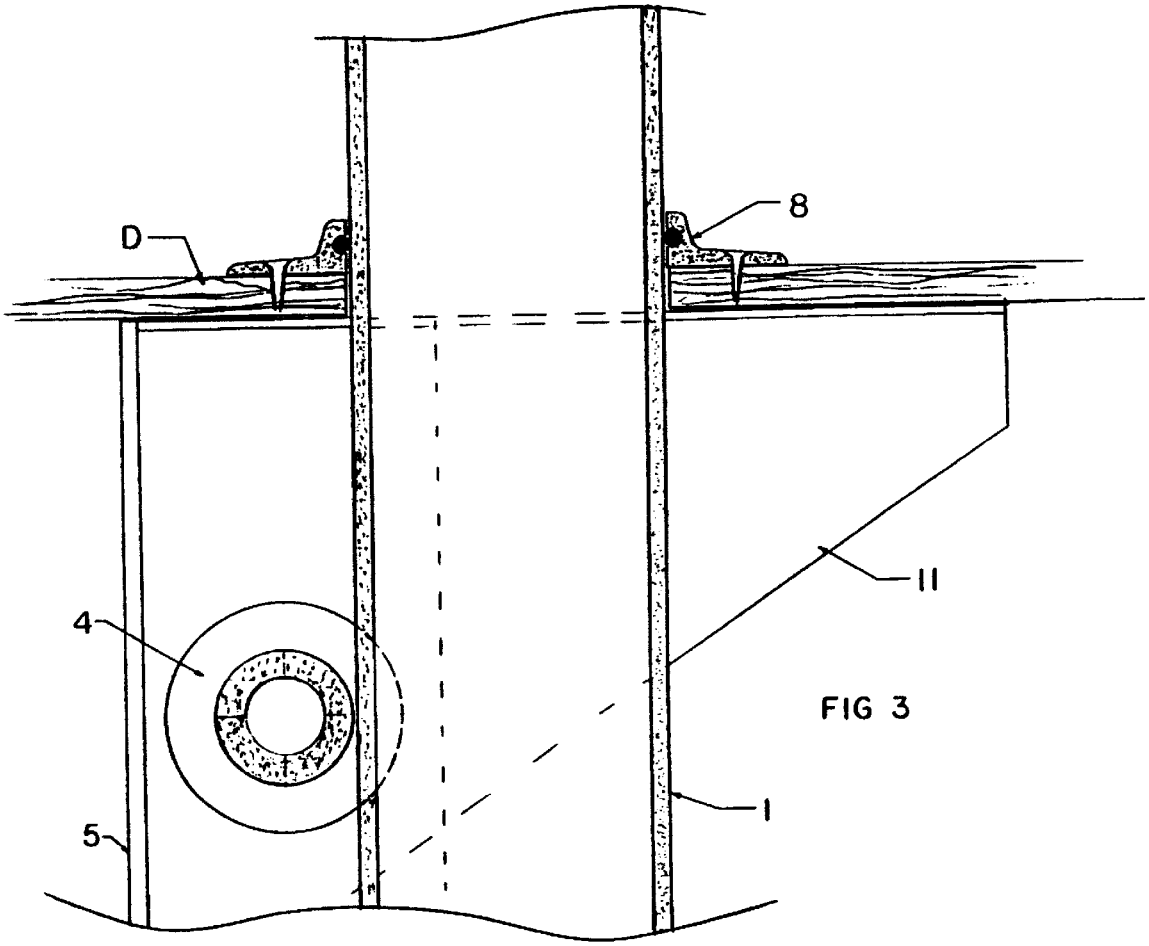
FIG. 3 is a fragmentary cutaway view of the bent tube as it exits the deck showing a watertight O ring seal and its housing.

FIG. 3 is a cutaway fragmented view of 1 as it exits the deck D. 8 is a casting or fabrication which houses an O ring seal. 11 is a gusset that is connecting 5 to D, stiffening and strengthening the top of 5. 6 shown in FIG. 1 or FIG. 2 may also be fastened to 11.

Figure 4:
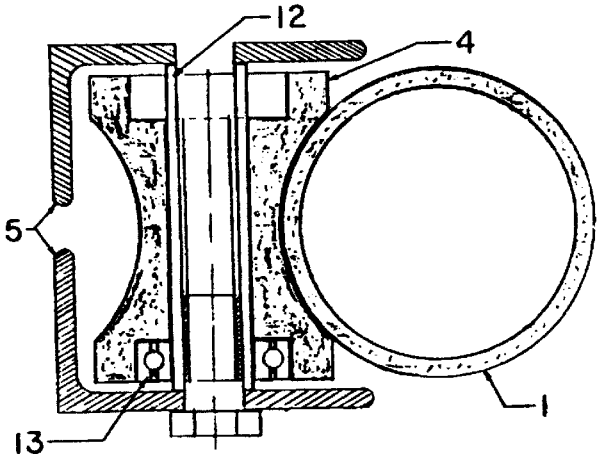
FIG. 4 is a fragmentary cutaway view of the bent tube, roller and its supporting structure.

FIG. 4 shows a cutaway view of one of the rollers 4 as housed in the cradle 5. Note if 1 is a bent metal tube or pipe the rollers 4 must be made of a softer material than 1 or extended use may change the radius of 1. 5 are two metal angles bent to a radius that conforms to the radius of 1. The rollers 4 are suspended by bearings 13. A threaded spacer tube 12 supports the bearings 13 and enables the angles 5 to be bolted together so that 4 can roll freely under load.

The mechanism can be powered and kept in position as shown in FIG. 2 by pulling the line or cable 7 with a hydraulic system, a winching system, or a mechanical geared device. The mechanism could also be powered with a cable or line attached to the outer end of the strut 2 running through a sheave on deck D to the power source.

When designing the installation of this mechanism it will work best if the forestay connection, the pivot point 9, and the mainsheet connection are in a straight line perpendicular to the rake of the mast.

The mechanism should also be fitted with a locking pin or clamp brake that would hold the mast in the vertical position should there be a failure with the system that powers the mechanism. In the event of a failure the mast could be righted with halyards or running back stays and then locked into the vertical position.

Although this mechanism was designed for use with single masted sailboats, it will be readily apparent that the mechanism is capable of other uses, such as multi-masted sailboats, land-sailers, ice boats, and other land and water based applications. Although this invention has been described in its preferred form with a certain degree of particularity with respect to a single masted sailboat, it is understood that the present disclosure of the preferred form has been made only by way of example and that numerous changes in the details of structures and the composition of the system may be resorted to without departing from the spirit and scope of the invention.

What is claimed is:

1. A mechanism for laterally inclining a mast and its rig, said mechanism being comprised of:

a. a round tube or pipe formed to a radius into which a straight hollow housing is affixed vertically to the bottom center of said formed tube housing said mast; a plurality of struts are affixed to said mast housing connecting said mast housing to said formed tube constituting a structure which supports said mast and its stays as one unit;

b. a plurality of rollers mounted in a cradle which conforms to the radius of said round tube or pipe supporting the weight of the mast, rig, and structure, and allowing said structure to be moved in either direction within said cradle;

c. a wire rope or line attached to said structure that when pulled upon would move said structure along said cradle; and d. an O ring seal or cast of rubber where said structure passes through a deck, prohibiting water from intruding through deck holes created by the installation of said structure;

whereby said mechanism enables the user to laterally incline said mast and rig against wind pressure or the force of gravity.

* * * * *